US006267371B1

(12) United States Patent
Jessop

(10) Patent No.: US 6,267,371 B1
(45) Date of Patent: Jul. 31, 2001

(54) RECEIVER SHEET SUPPLY CASSETTE, FOR HOLDING A SUPPLY OF SHEETS DEFINING A STACK OF SHEETS AND METHOD OF ASSEMBLING SAME

(75) Inventor: Thomas C. Jessop, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/124,575

(22) Filed: Jul. 29, 1998

(51) Int. Cl.[7] ..... B65H 1/00

(52) U.S. Cl. ..... 271/171; 271/223; 271/234; 271/162

(58) Field of Search ..... 271/171, 223, 271/234, 162

(56) References Cited

U.S. PATENT DOCUMENTS

| | | | |
|---|---|---|---|
| 3,861,670 | 1/1975 | Kraft | 271/122 |
| 3,936,044 | 2/1976 | Kramer | 271/122 |
| 4,032,136 | 6/1977 | Komaba et al. | 271/166 |
| 4,106,763 | 8/1978 | Tani et al. | 271/9 |
| 4,780,740 | 10/1988 | Fukae | 271/3 |
| 4,944,504 | 7/1990 | Yamada et al. | 271/171 |
| 5,411,252 | 5/1995 | Lowel | 271/171 |
| 5,433,427 | 7/1995 | Ishikawa et al. | 271/126 |
| 5,611,528 * | 3/1997 | Nakakmura et al. | 271/171 X |
| 5,931,456 * | 8/1999 | Laidlaw | 271/171 |
| 5,944,308 * | 8/1999 | McLeod et al. | 271/171 |

FOREIGN PATENT DOCUMENTS

| | | | |
|---|---|---|---|
| 186060 * | 7/1993 | (JP) | 271/171 |

* cited by examiner

*Primary Examiner*—Robert P. Olszewski
*Assistant Examiner*—Richard Ridley
(74) *Attorney, Agent, or Firm*—Walter S. Stevens

(57) ABSTRACT

Printer and receiver supply cassette therefor, and method of assembling same. A printer comprises a print head for printing an image on any of a plurality of receiver sheets arranged in a stack. A receiver sheet supply cassette is also provided, which cassette comprises a cassette body having a plurality of notches formed therein. A backstop is connected to the cassette body. The backstop has a portion thereof adapted to engage any of the notches. In this manner, the backstop is fixed relative to the cassette body while the portion of the backstop engages the notch. The cassette also includes a rotatable beam connected to the stop portion, so that the stop portion disengages the notch as the beam rotates and lifts the stop portion.

16 Claims, 9 Drawing Sheets

RECEIVER SHEET SUPPLY CASSETTE, FOR HOLDING A SUPPLY OF SHEETS DEFINING A STACK OF SHEETS AND METHOD OF ASSEMBLING SAME

BACKGROUND OF THE INVENTION

The present invention generally relates to printer apparatus and methods and more particularly relates to a printer and receiver supply cassette therefor, and method of assembling same.

Thermal printers form a color print by successively printing with a dye donor onto individual sheets of a dye receiver (i.e., paper or transparency). The print head of such a thermal printer commonly includes a print line of thermal resistive elements that can be individually heated in order to transfer dye from the donor to the receiver. Such print heads can take any of several forms including resistive element, resistive ribbon and laser print heads.

More specifically, a typical color thermal printer includes the previously mentioned print head and a platen. A picker mechanism "picks" individual sheets of the receiver from a stack of cut sheets of the receiver and feeds the individual sheets into a nip area defined between the print head and platen. The print head is then lowered, so that the donor and receiver sheet are sandwiched between the print head and platen. An image is printed on the sheet by selectively heating the elements of the print head in order to transfer a first dye to the receiver sheet. The receiver sheet is then repositioned to receive a second color of the image, and the donor is positioned to provide a second dye color. These steps are repeated until all colors of the image are printed and the completed print is ejected from the printer.

Moreover, a receiver supply tray loaded with the stack of cut receiver sheets is removably inserted into the printer for providing a supply of sheets of a predetermined size to be printed by the print head. A typical supply tray includes an adjustable backstop for restraining longitudinal movement of the stack of cut sheets. The backstop is adjustable for accommodating various sizes of receiver sheets. However, this backstop typically includes a plurality of individual parts that must themselves be manufactured and thereafter precisely assembled during manufacture of the supply tray. Such, manufacture and assembly of these parts complicates manufacture of the supply tray and therefore increases manufacturing costs. Therefore, a problem in the art is increased costs due to manufacture and assembly of supply trays having a plurality of moving parts.

Receiver supply trays having backstops are known. A feed cassette for use with copying machines is disclosed in U.S. Pat. No. 4,032,136 titled "Feed Cassette" issued Jun. 28, 1977 in the name of Shiro Komaba, et al. This patent discloses a slidable limit plate for positioning copy mediums in accordance with the sizes thereof. The limit plate is attached to an inner plate and is locked by a stop plate that is received in a corresponding rectangular opening formed in the inner plate. Although the Komaba, et al. patent discloses a limit plate for positioning copy mediums, the Komada et al. device nonetheless includes an assemblage of individual parts that apparently must be separately manufactured and then precisely assembled. Therefore, the Komada et al. device does not appear to address the problem of increased costs due to assembling supply trays having a plurality of individual parts.

In addition, prior art supply trays commonly include "click type" detents in which the backstop detent is chamfered and is overpowered by the operator when the operator needs to move the backstop to a different position. Click type detents must try to strike a balance between force necessary to retain the receiver and force that the operator is comfortable in applying to move the backstop. Click type detents are subject to reduction of retaining force by wear.

Therefore, there has been a long-felt need to provide a suitable printer and receiver supply cassette therefor, and method of assembling same which overcome the above-recited problems associated with the prior art.

SUMMARY OF THE INVENTION

An object of the present invention is to provide a suitable printer and receiver supply cassette therefor, and method of assembling same which overcome the above-recited problems associated with the prior art.

With this object in view, the present invention resides in a printer, comprising a print head; a cassette body associated with said print head, said cassette body having a notch therein; a stop connectable to said cassette body, said stop having a portion thereof adapted to releasably engage the notch; and a beam connected to the stop portion for pivoting the stop portion, so that the stop portion disengages the notch as said beam pivots the stop portion.

In one embodiment of the present invention, a receiver sheet supply cassette comprises a cassette body which has a plurality of notches formed therein. A backstop is connected to the cassette body, which backstop has a portion thereof adapted to engage the notch. In this manner, the backstop is fixed relative to the cassette body while the portion of the backstop engages the notch. The cassette also includes a beam connected to the stop portion for pivoting the stop portion, so that the stop portion disengages the notch as the beam pivots the stop portion. The backstop and beam are preferably of a single unitary construction of molded plastic for ease of manufacture.

A feature of the present invention is the provision of a stop having a portion thereof connected to a rotatable beam, so that the stop rotates and lifts as the beam rotates.

Another feature of the present invention is the provision of a stop and beam of a single unitary construction.

An advantage of the present invention is that manufacturing costs are reduced.

Another advantage of the present invention is that when the stop portion engages the notch, the force available to retain the receiver is virtually unlimited. On the other hand, when the stop is lifted-out of the notch very light forces are sufficient to readjust position of the backstop.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

FIG. 1 is a view in perspective of a printer belonging to the present invention, the printer having a receiver supply cassette disposed therein to;

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
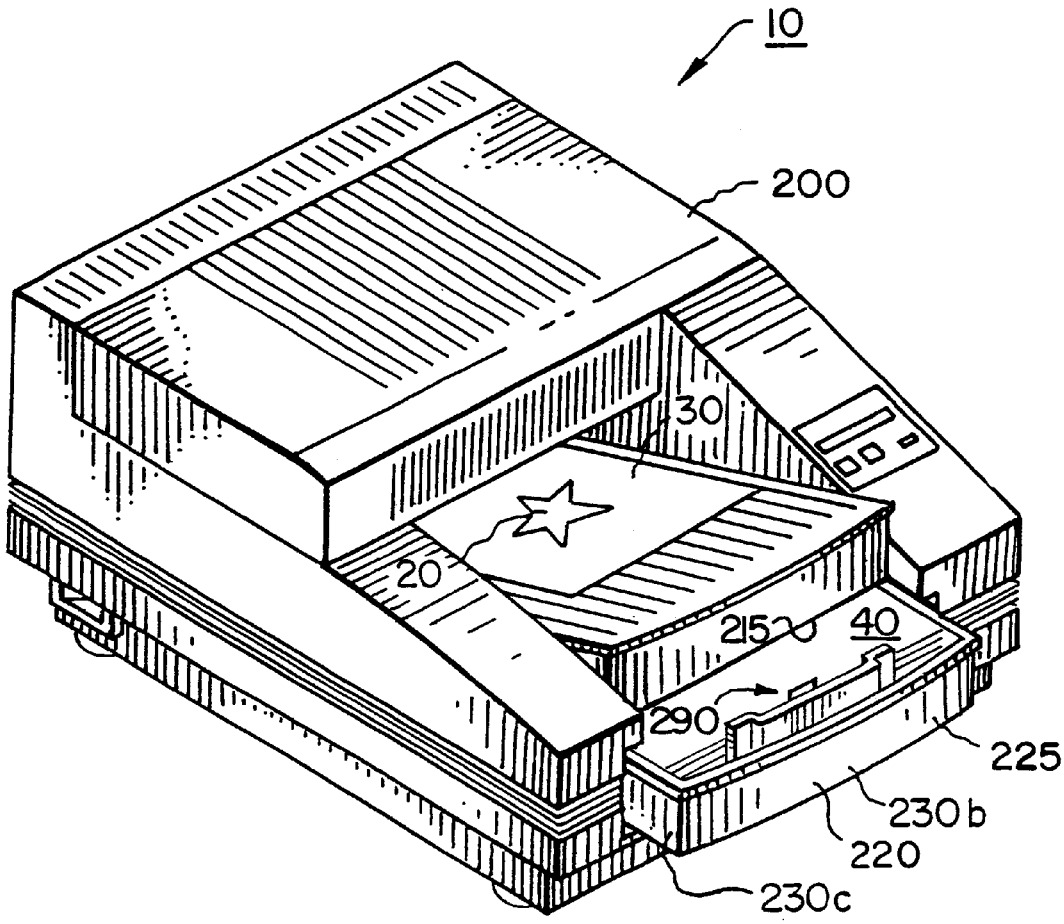
Figure 2:
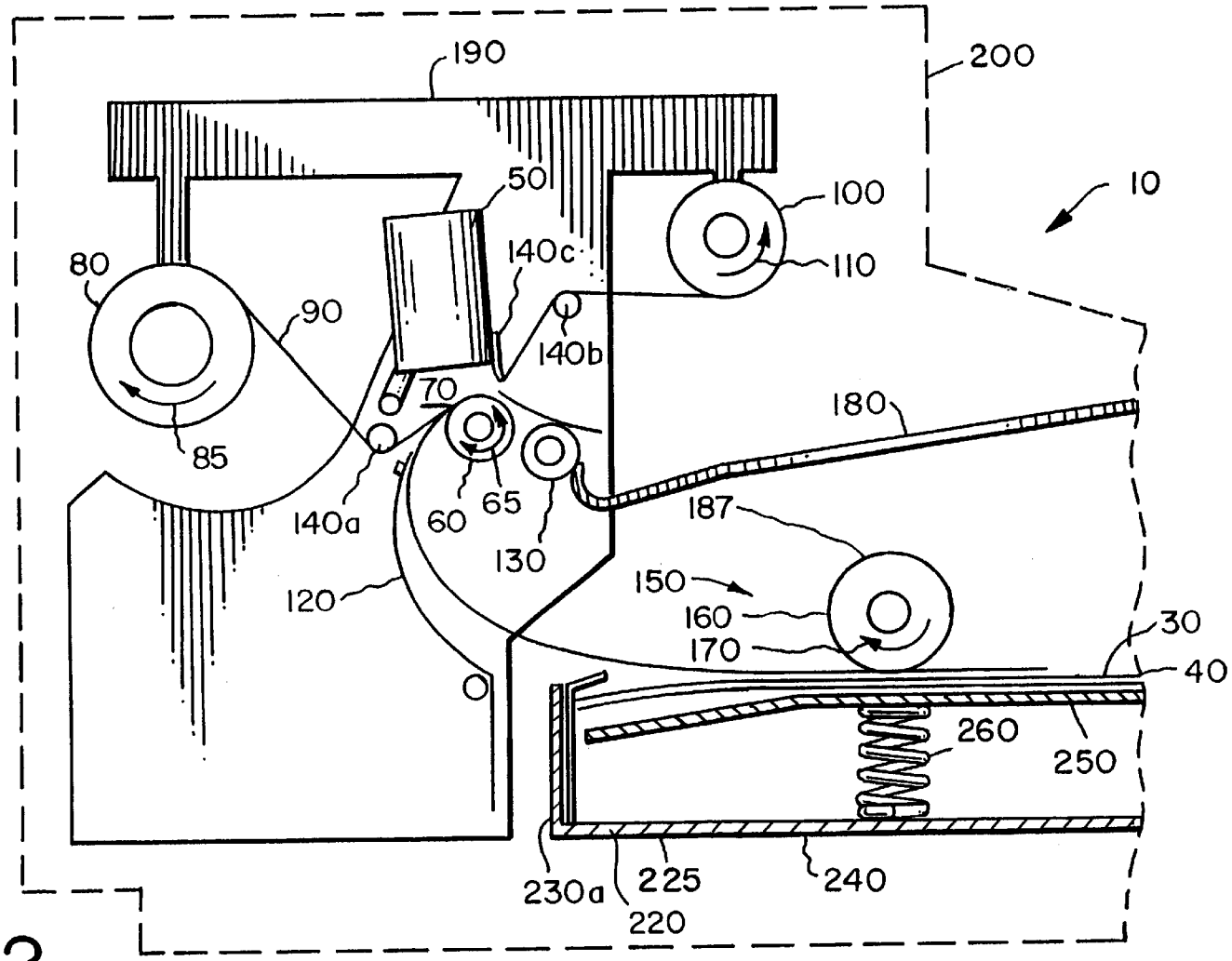
FIG. 2 is a view in vertical section of the printer with parts removed for clarity.
Figure 3:
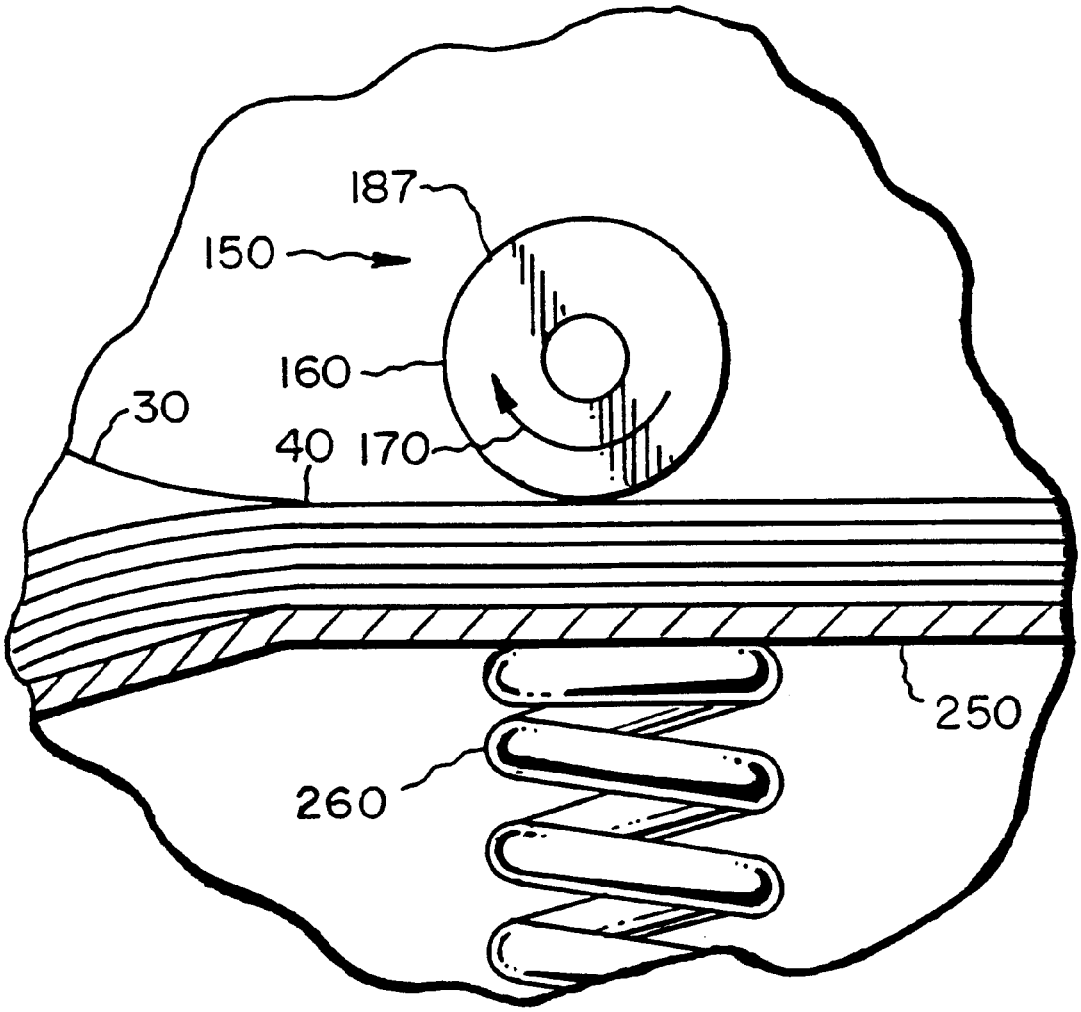
FIG. 3 is a fragmentation view in vertical section of a portion of a platen belonging to the supply cassette, the platen having a stack of cut sheets of receiver disposed thereon and being supplied therefrom by means of a feeder mechanism engaging the stack of receiver sheets.

Therefore, referring to FIGS. 1, 2 and 3, there is shown a thermal resistive printer, generally referred to as 10, for forming an image 20 on a receiver sheet 30 which may be paper or transparency. A plurality of the receiver sheets 30 define a stack 40 of receiver sheets. Printer 10 comprises a thermal resistive print head 50 formed of a plurality of resistive heating elements (not shown), for reasons disclosed hereinbelow. Disposed opposite print head 50 is a support 60 for supporting and transporting receiver sheet 30 through printer 10, which support 60 is adapted to rotate bi-directionally as shown by a double-headed first arrow 65. In this regard, support 60 may be connected to a reversible motor (not shown) for rotating support 60 bi-directionally. Print head 50 and support 60 define a collapsible nip 70 therebetween for passage of receiver sheet 30 therethrough. In this regard, nip 70 is capable of being opened and closed when print head 50 is upwardly and downwardly moved, respectively, with respect to support 60. Receiver sheet 30 is reversibly transported through nip 70 by means of engagement with rotatable support 60. As receiver sheet 30 is transported through nip 70, the nip 70 is closed and the previously mentioned heating elements are activated to cause printing of image 20 onto receiver sheet 30, as described more fully hereinbelow.

Referring again to FIGS. 1, 2 and 3, printer 10 further comprises a dye donor supply spool 80 adapted to freely rotate in a direction of a second arrow 85. Wound about donor supply spool 80 is a movable dye donor ribbon 90 containing a plurality of dye-containing color patches (not shown). Disposed relative to donor supply spool 80 is a dye donor take-up spool 100 adapted to rotate in a direction of a third arrow 110. In this regard, take-up spool 100 is connected to a motor (not shown) for rotating take-up spool 100 in the direction of third arrow 110. Donor supply spool 80 supplies dye donor ribbon 90 from donor supply spool 80 to take-up spool 100 as take-up spool 100 rotates. It may be understood that as donor supply spool 80 supplies dye donor ribbon 90 therefrom to take-up spool 100, ribbon 90 will be suspended between spools 80 and 100 and pass through nip 70, such that ribbon 90 passes between receiver sheet 30 and print head 50. It may be further understood that as nip 70 closes, the previously mentioned heating elements in print head 50 are enabled such that radiative heat therefrom causes dye to transfer from ribbon 90 to receiver sheet 30 in order to form image 20 on receiver sheet 30. More specifically, as ribbon 90 is sandwiched between print head 50 and receiver sheet 30, image 20 is printed by selectively heating individual ones of the heating elements in print head 50 in order to transfer a first dye to receiver sheet 30. Receiver sheet 30 is then repositioned by means of rotating support 60 to receive a second color of the image, and ribbon 90 is positioned by means of take-up spool 100 to provide a second dye color. These steps are repeated until all colors of image 20 are printed and the completed print is ejected from printer 10.

Referring yet again to FIGS. 1, 2 and 3, movement of ribbon 90 through nip 70 and enablement of the heating elements in print head 50 are preferably synchronized to transfer the dyes from ribbon 90 to receiver sheet 30 at the desired times and predetermined locations on receiver sheet 30. Therefore, a control unit (not shown) is connected to print head 50 for controlling print head 50, so that the heating elements are enabled when desired. Also, the control unit may be connected to print head 50 for upwardly and downwardly moving print head 30 in order to open and close nip 70 when required. The control unit may also be connected to take-up spool 100 for controlling rotation of take-up spool 100, so that operation of take-up spool 100 is synchronized with operation of print head 50.

Still referring to FIGS. 1, 2 and 3, printer 10 also comprises a guide ramp 120 and a freely rotatable guide roller 130 aligned with nip 70 for guiding receiver sheet 30 into and through nip 70, respectively. In addition, a plurality of tensioners 140*a*, 140*b* and 140*c* are provided for tensioning ribbon 90 for reasons well known in the art. Also, a feeder mechanism, generally referred to as 150, is also provided for "feeding" individual receiver sheets 30 from stack 40, so that individual sheets 30 feed onto guide ramp 120. Feeder mechanism 150 includes a picker roller 160 rotatable in a direction of a fourth arrow 170 by means of a motor (not shown). Moreover, an output receptacle 180 is positioned to receive sheet 30 when image 20 is completely printed thereon. Print head 50, support 60, supply spool 80, take-up spool 100, guide 120, guide roller 130, tensioners 140 *a/b/c,* and feeder mechanism 150 are preferably connected to a frame 190 for supporting these components within printer 10. These components, including frame 190, are enclosed within a printer enclosure 200 for protecting the components from damage, which enclosure 200 has an opening 215 therein for reasons disclosed hereinbelow.

Referring to FIGS. 3, 4, 5, 6A and 6B, the invention also comprises a receiver sheet supply cassette 220 disposed near print head 50 for holding stack 40 of receiver sheets 30, which cassette 220 is sized to be received into opening 215 and thus into enclosure 200. Cassette 220 includes a cassette body 225 comprising a front sidewall 230*a* and a rear sidewall 230*b* parallel to front sidewall 230*a* and spaced-apart therefrom. Interposed between front sidewall 230*a* and rear sidewall 230*b* are a first lateral sidewall 230*c* and a second lateral sidewall 230*d*, the second lateral sidewall 230*d* being parallel to first lateral sidewall 230*c* and spaced-apart therefrom. Cassette body 225 also includes a floor 240 integrally attached to sidewalls 230*a/b/c/d*. Moreover, formed in floor 240 are a plurality of notches 245 for reasons disclosed hereinbelow. Each notch 245 is, at least in part, defined by a first side-edge 246 and an oppositely disposed second side-edge 248. Cassette body 225 may further include a removable cover plate (not shown) extending from first lateral sidewall 230*c* to second lateral sidewall 230*d* and resting thereon for protecting stack of sheets 40 from fouling by external dirt, dust and the like while tray 220 is received into opening 215. In addition, disposed inwardly of panels sidewalls 230*a/b/c/d* is a movable platen 250 supported on floor 240 by at least one biasing member, such as a coiled spring 260, which upwardly biases platen 250 into contact with stack 40. Spring 310 is preferably attached both to platen 250 and floor 240, so that platen 250 remains connected to cassette body 225.

Figure 4:
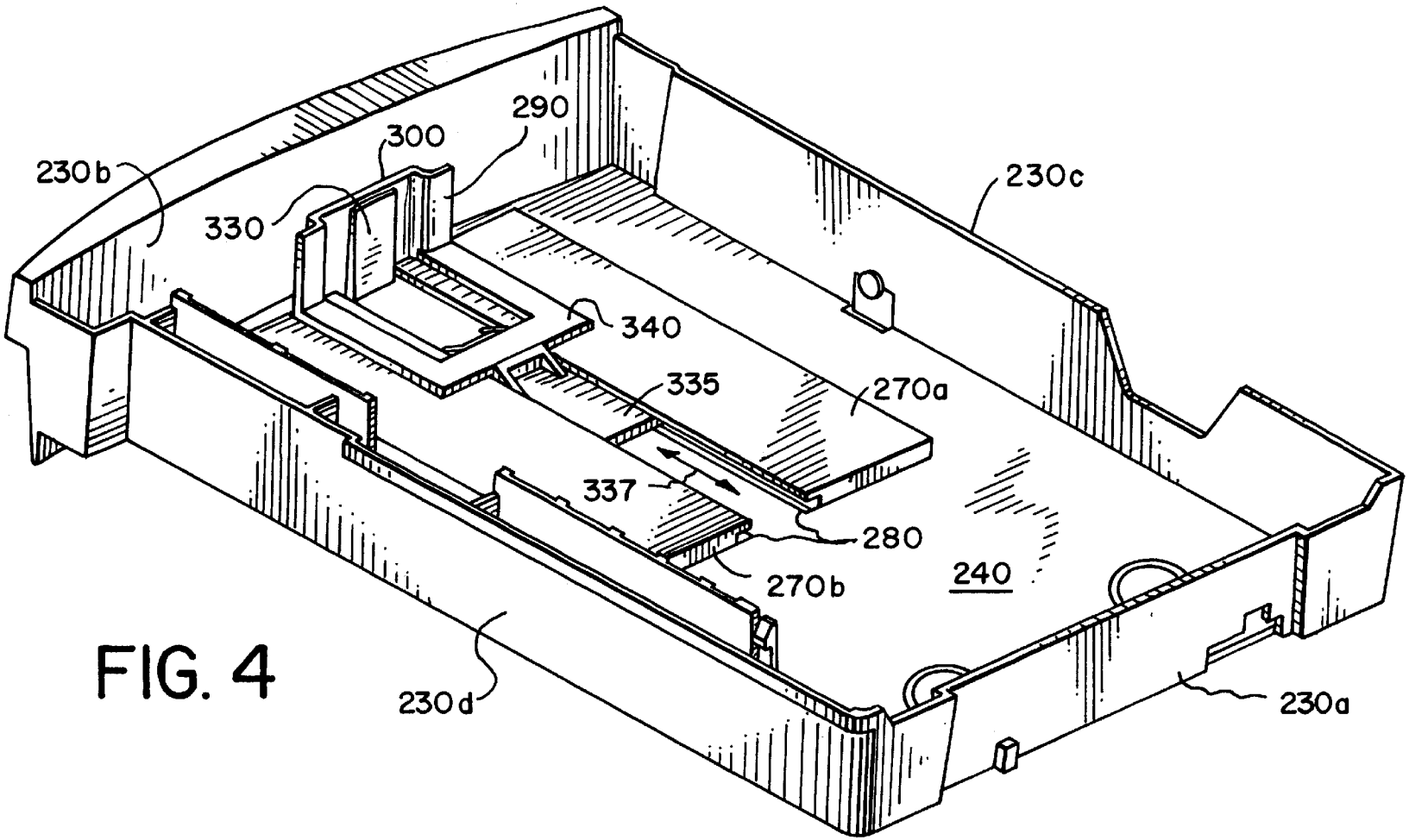
FIG. 4 is a view in perspective of the cassette with parts removed for clarity, this view showing a backstop for constraining movement of the stack of cut sheets.
Figure 5:
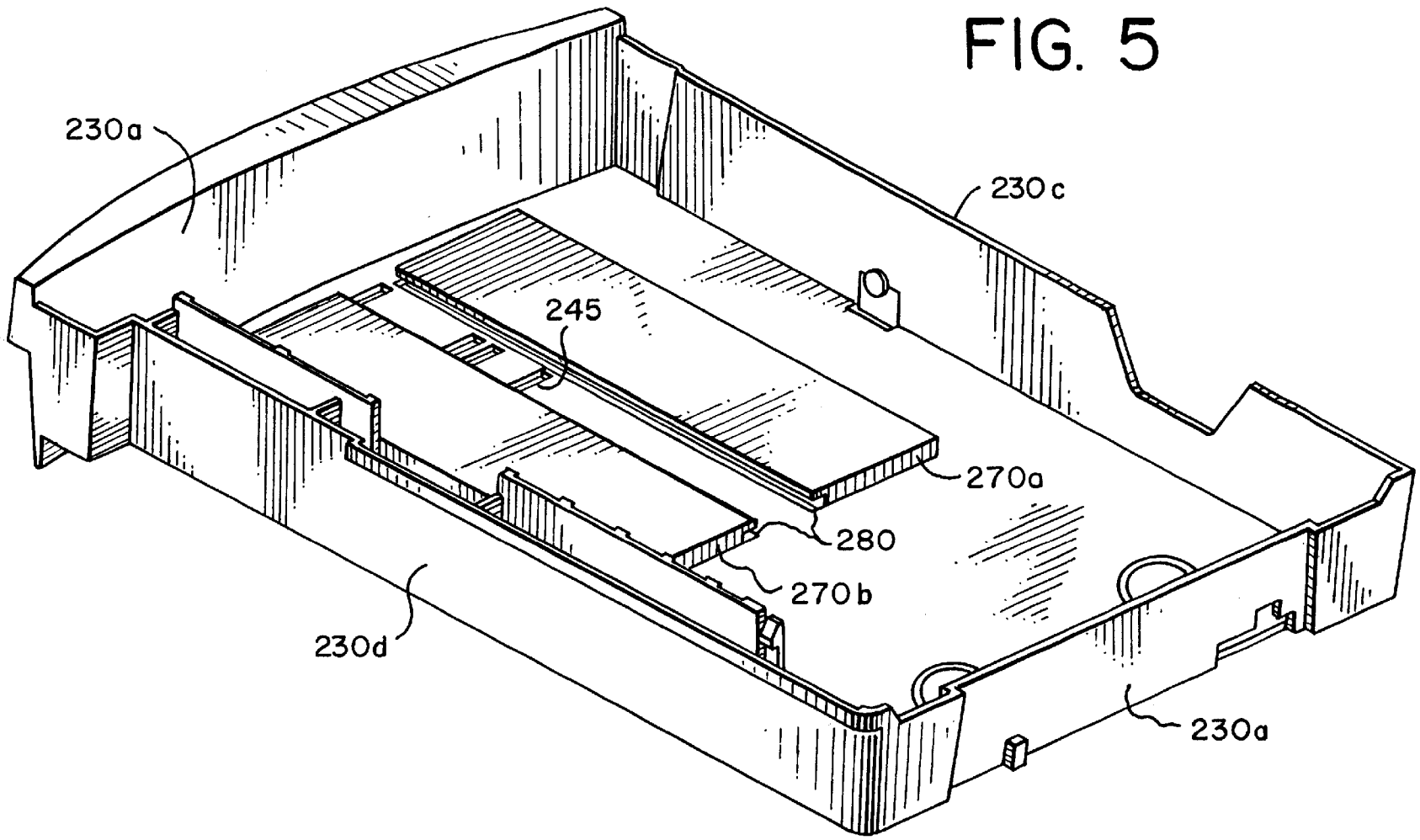
FIG. 5 is a view in perspective of the cassette without the backstop being shown for reasons of clarity, this view showing a plurality of guide rails for slidably guiding the backstop.
Figure 6A:
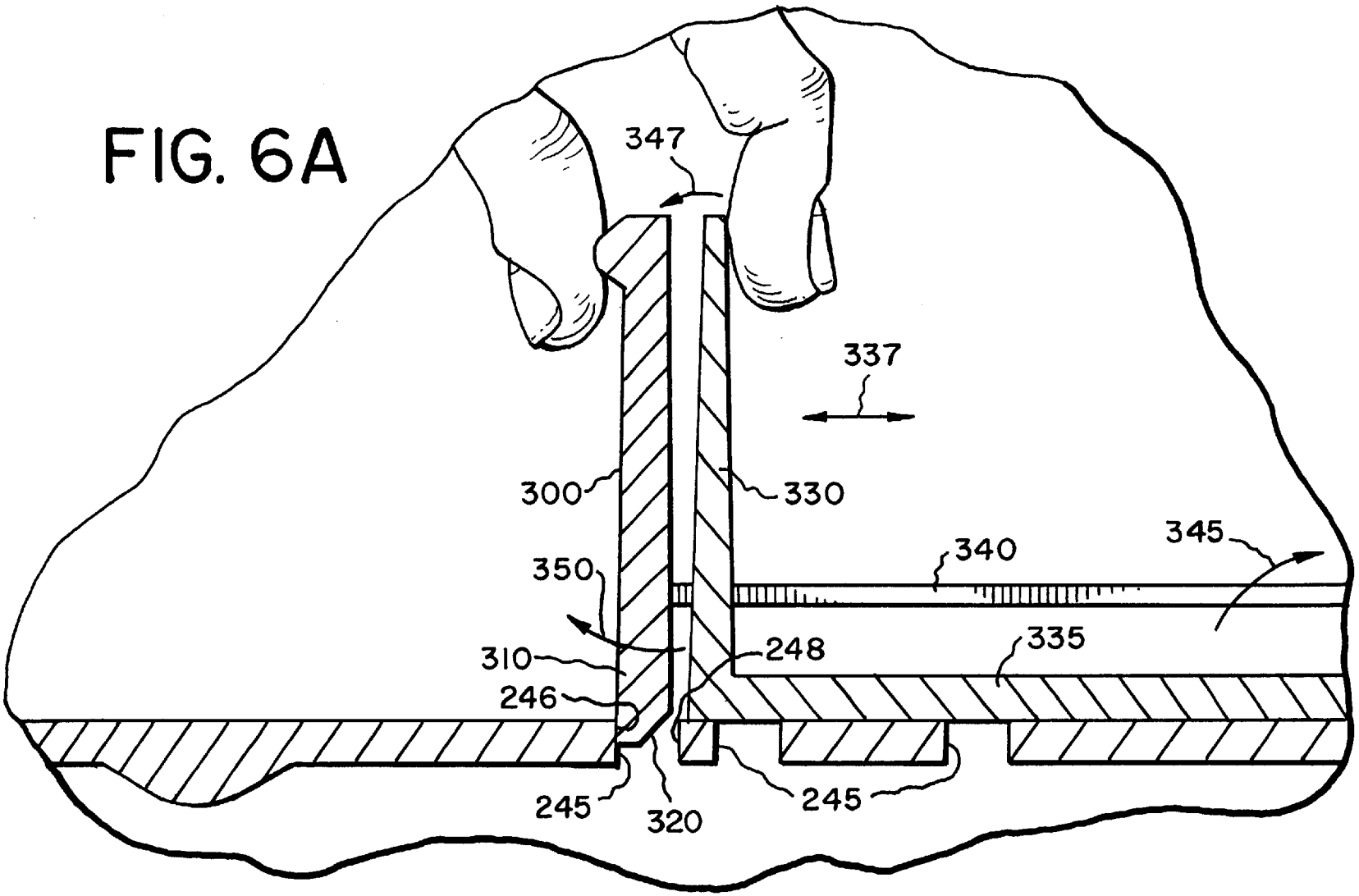
FIG. 6A is a fragmentation view in elevation of a first prong member and a second prong member belonging to the backstop, the first prong member engaging the notch.
Figure 6B:
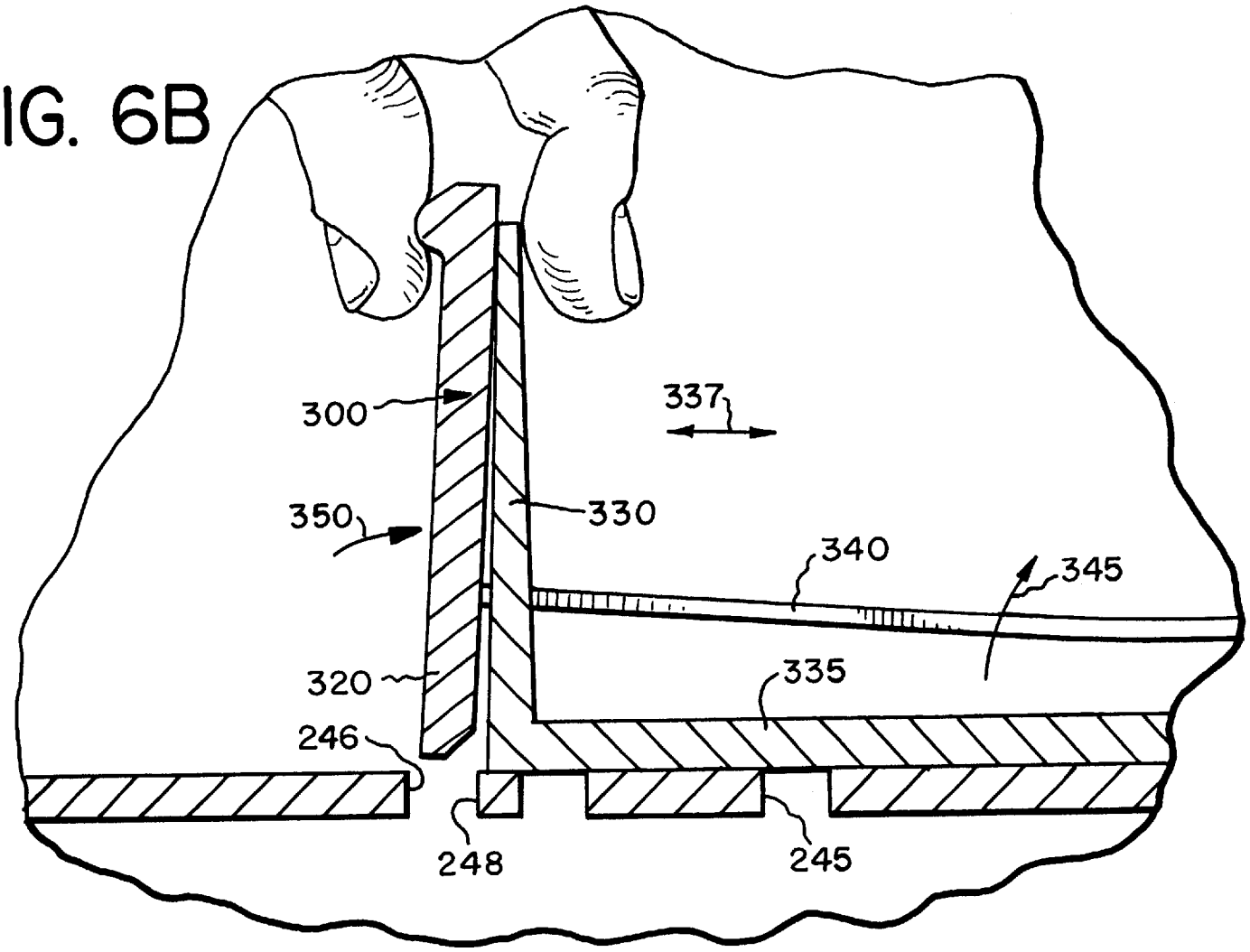
FIG. 6B is a fragmentation view in elevation of the first prong member and the second prong member belonging to the backstop, the first prong member having disengaged the notch by means of the operator's pinching action.

Referring to FIGS. 4 and 5, cassette body 225 is there shown with parts removed for clarity. In addition to the elements described hereinabove, cassette body 225 further comprises two parallel guide rails 270*a* and 27*b*, each having a groove 280 formed therein for reasons disclosed presently. Connected to guide rails 270*a/b*, and thus to cassette body 225, is a movable backstop, generally referred to as 290, for constraining longitudinal movement of stack of sheets 40 as feeder mechanism 150 feeds individual sheets 30 from stack of sheets 40. It is important to constrain movement of stack of sheets 40. This is important because each sheet 30 must be presented to picker roller 160 in an identical position; otherwise, risk of a sheet misfeed increases thereby leading to increased risk of paper "jams". It is desirable to avoid paper "jams" because paper "jams" can cause printer 10 to be inoperable until the paper "jam" is cleared. In addition, backstop 290 ensures that position of stack of sheets 40 in cassette body 225 remains fixed as cassette 220 is manually transported from one location to another.

Referring to FIGS. 4, 5, 6A and 6B, backstop 290 includes an upright first prong member 300 having a portion 310 thereof releasably engaging notch 245. It may be appreciated that backstop 290 is releasably locked to cassette body 225 as portion 310 of first prong member 300 engages notch 245. Portion 310 of first prong member 300 has a chamfered side 320 for camming up and over side-edge 248 lifting first prong member 300 and disengaging said first prong member 300 from notch 245 as the operator pushes backstop 290 forward into engagement with receiver sheets stored in the tray 230. Backstop 290 is made immovable with respect to cassette body 225 as portion 310 engages notch 245. Backstop 290 also includes an upright second prong member 330 disposed adjacent first prong member 300. Integrally connected to second prong member 330 and projecting laterally outwardly therefrom is a tongue member 335 for matingly slidably engaging grooves 280 in order that backstop 290 is controllably slidable generally in the direction of double-headed arrow 337. Interconnecting first prong member 300 and second prong member 330 is a rotatable, preferably flexible beam 340. The purpose of beam 340 is to rotate and lift first prong member 300 out of engagement with notch 245. In this regard, beam 340 rotates generally in the direction of a sixth arrow 345 as second prong member 330 is flexed, such as by being manually flexed, generally in the direction of a seventh arrow 347. As beam 340 rotates, first prong member 300 rotates generally in the direction of an eighth arrow 350. As first prong member 300 rotates, the end of first prong member 310 disengages from notch 245. In this manner, backstop 290 is no longer immovable with respect to cassette body 225; rather, backstop 290 becomes easily movable with respect to cassette body 225, such as in the direction of fifth arrow 337. Thus, backstop 290 may be caused to engage any of notches 245 for fixing backstop 290 with respect to cassette body 225 when prong member portion 310 engages notch 245. Backstop 290 then may be caused to disengage that notch 245 for allowing backstop 290 to be movable with respect to cassette body 225. Moreover, first prong member 300, second prong member 330, and beam 340 may be of a single unitary construction formed from a molded and flexible plastic material, such as polycarbonate/ABS alloy. Also, first prong member 300, second prong member 330, and beam 340 may be of a single unitary construction, rather than being constructed from a plurality of parts, in order to lower manufacturing costs for receiver sheet supply cassette 220.

Figure 7:
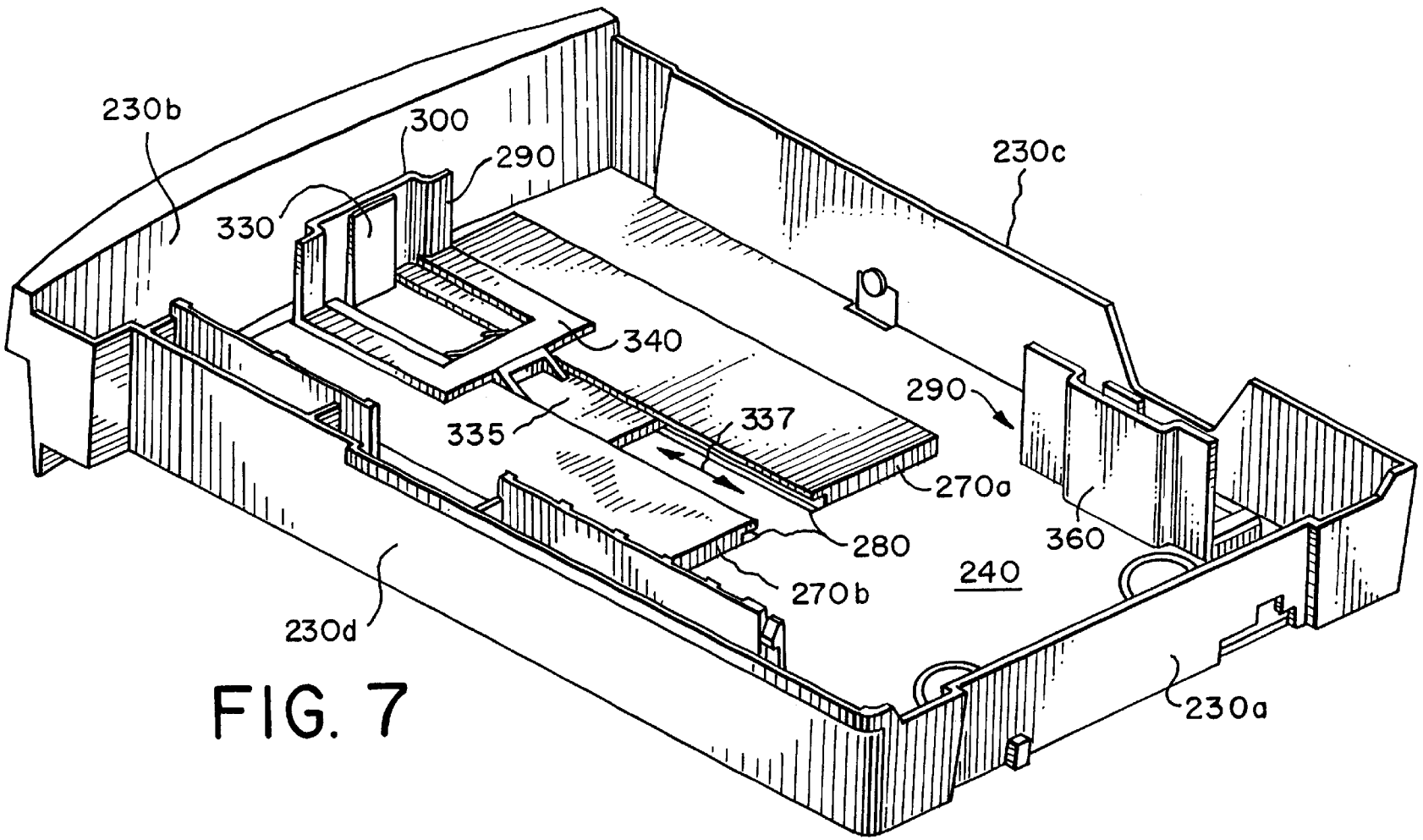
FIG. 7 is a view in perspective of a second embodiment of the cassette with parts removed for clarity, this view showing a side stop for constraining lateral movement of the stack of cut receiver sheets.
Figure 8:
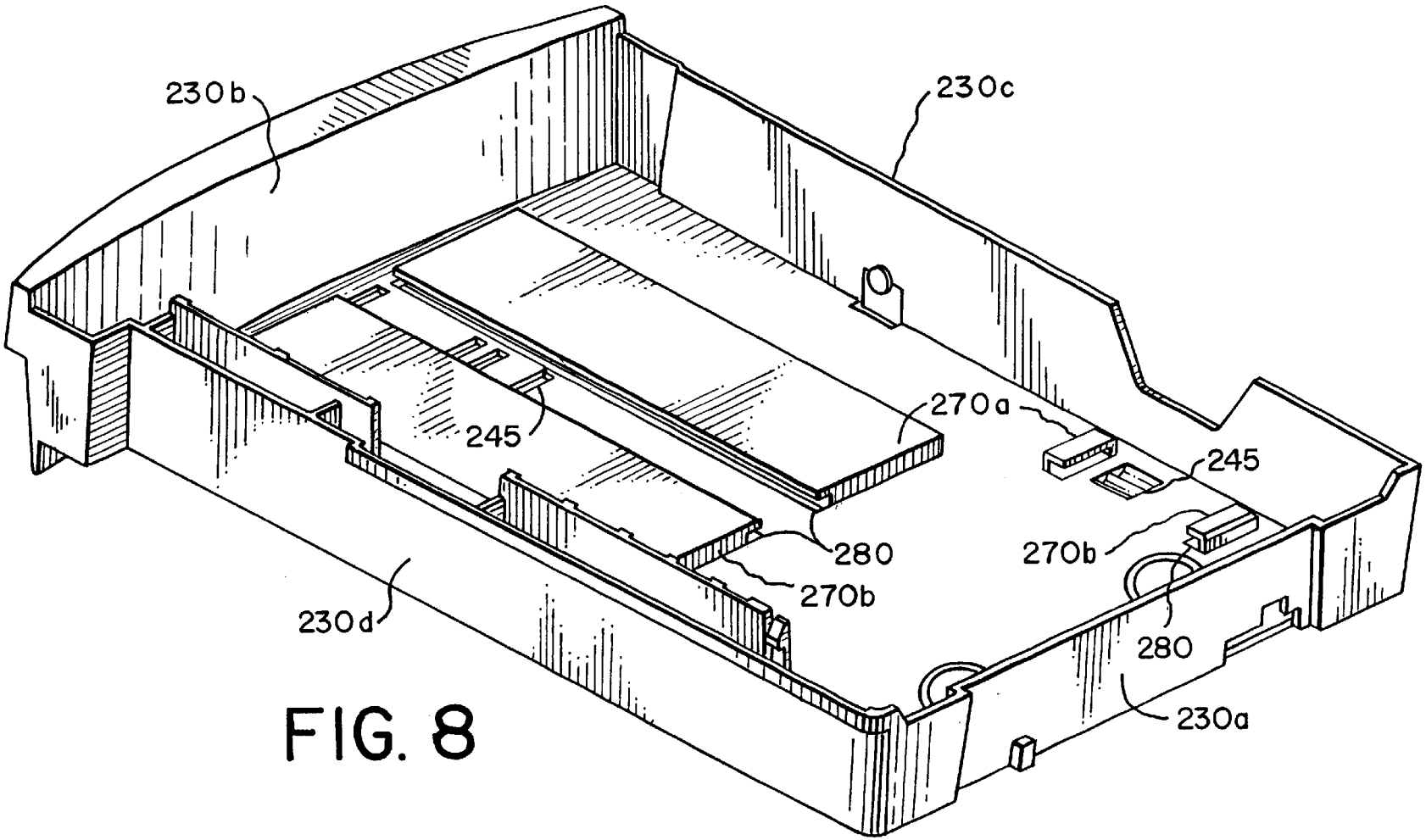
FIG. 8 is a view in perspective of the second embodiment cassette without the side stop being shown for reasons of clarity, this view showing a plurality of guide rails for slidably guiding the side stop.

Turning now to FIGS. 7 and 8, there is shown a second embodiment of cassette 220. This second embodiment cassette 220 is substantially similar to the first embodiment cassette 220, except that a side stop 360, beam 340 and guide rails 270 are disposed adjacent first lateral sidewall 230*c* in addition to the previously mentioned backstop 290 being disposed adjacent rear sidewall 230*b*. Alternatively, side stop 360, beam 340 and guide rails 270 may be disposed adjacent second lateral sidewall 230*d* in addition to the previously mentioned backstop 290 being disposed adjacent rear sidewall 230*b*, if desired. As yet another alternative, there may be two side stops 360 respectively disposed adjacent lateral sidewalls 230*c/d* in combination with backstop 290 being disposed adjacent rear sidewall 230*b* to provide maximum immobility for stack of sheets 40.

It may be appreciated from the teachings hereinabove, that movable backstop 290 allows cassette 220 to accommodate receiver sheets of virtually any length, depending on spacing between notches 245. For example, cassette 220 can accommodate receiver sheets of size 8" by 11" (i.e., "letter size"), 8.5" by 11.69", 8½" by 13", or 8½" by 14" (i.e., "A4 size").

While the invention has been described with particular reference to its preferred embodiments, it will be understood by those skilled in the art that various changes may be made and equivalents may be substituted for elements of the preferred embodiments without departing from the invention. In addition, many modifications may be made to adapt a particular situation and material to a teaching of the present invention without departing from the essential teachings of the invention. For example, cassette 220 is disclosed herein for use with a thermal printer. However, cassette 220 can also be used with other printer types, such as an ink jet printer.

Therefore, what is provided is a printer and receiver supply cassette therefor, and method of assembling same.

| PARTS LIST | |
|---|---|
| 10 | printer |
| 20 | image |
| 30 | receiver sheet |
| 40 | stack of receiver sheets |

-continued

| PARTS LIST | |
|---|---|
| 50 | print head |
| 60 | support |
| 65 | first arrow |
| 70 | nip |
| 80 | dye donor supply spool |
| 85 | second arrow |
| 90 | dye donor ribbon |
| 100 | dye donor take-up spool |
| 110 | third arrow |
| 120 | guide ramp |
| 130 | guide roller |
| 140a/b/c | tensioners |
| 150 | feeder mechanism |
| 160 | picker roller |
| 170 | fourth arrow |
| 180 | output receptacle |
| 190 | frame |
| 200 | printer enclosure |
| 215 | opening |
| 220 | receiver sheet supply cassette |
| 225 | cassette body |
| 230a | front sidewall |
| 230b | rear sidewall |
| 230c | first lateral sidewall |
| 230d | second lateral sidewall |
| 240 | floor (of cassette body) |
| 245 | notch |
| 246 | first side-edge |
| 248 | second side-edge |
| 250 | platen |
| 260 | spring |
| 270 | guide rails |
| 280 | groove |
| 290 | backstop |
| 300 | first prong member |
| 310 | portion of first prong member |
| 320 | chamfered side |
| 330 | second prong member |
| 335 | tongue member |
| 337 | fifth arrow |
| 340 | beam |
| 345 | sixth arrow |
| 347 | seventh arrow |
| 350 | eighth arrow |
| 360 | side stop |

What is claimed is:

1. A printer, comprising:

(a) a print head;

(b) a receiver sheet supply cassette associated with said print head for holding a supply of receiver sheets, said supply cassette including a cassette body having a notch therein; and (c) a movable backstop connected to said cassette body for constraining movement of the receiver sheets, said backstop including:

(i) a prong member having a portion thereof adapted to releasably engage the notch, so that said backstop is immovable in a direction away from the supply of receiver sheets as the prong portion engages the notch; and (ii) a beam connected to the prong portion to rotate and lift the prong portion out of engagement with the notch, so that said backstop is movable in a direction away from the supply of receiver sheets as the prong portion disengages the notch; and wherein said prong member and said beam are of a single unitary construction.

2. The printer of claim 1, wherein said prong member and said beam are molded integral of the same plastic.

3. A printer capable of printing an image on any of a plurality of receiver sheets defining a stack of sheets, comprising;

(a) a print head for printing the image;

(b) a feeder mechanism disposed near said print head, said feeder mechanism capable of engaging the stack of sheets and feeding individual sheets to said print head;

(c) a receiver sheet supply cassette disposed near said print head for holding the stack of sheets as said feeder mechanism feeds individual sheets to said print head, said cassette including a cassette body having a notch therein;

(d) a backstop movable with respect to said cassette body, said backstop connected to said cassette body for constraining movement of the stack of sheets as the individual sheets feed from the stack of sheets, said backstop including:

(i) a first prong member having a portion thereof releasably engaging the notch, so that said backstop is immovable with respect to said cassette body in a direction away from the stack of sheets as the first prong member portion engages the notch;

(ii) a second prong member disposed adjacent said first prong member; and (iii) a rotatable and flexible beam interconnecting said first prong member and said second prong member to rotate and lift said first prong member out of engagement with the notch, so that said first prong member rotates and rises as said beam is flexed, so that said first prong member portion disengages the notch as said beam rotates, and so that said backstop is movable with respect to said cassette body in a direction away from the stack of sheets as the first prong member portion disengages the notch.

4. The printer of claim 3, wherein said first prong member, said second prong member and said beam are of a single unitary construction of molded plastic.

5. A receiver sheet supply cassette, comprising:

(a) a cassette body for holding a supply of receiver sheets, said cassette body having a notch therein;

(b) a backstop connected to said cassette body for constraining movement of the receiver sheets, said backstop including:

(i) a prong member having a portion thereof adapted to releasably engage the notch, so that said backstop is immovable relative to said cassette body in a direction away from the supply of receiver sheets as the prong portion engages the notch; and (ii) a beam connected to the prong portion to rotate and lift the prong portion out of engagement with the notch, so that said backstop is movable in a direction away from the supply of sheets as the prong portion disengages the notch; and wherein said prong member and said beam are of a single unitary construction.

6. The cassette of claim 5, wherein s aid prong member and said beam are molded integral of the same plastic.

7. A receiver sheet supply cassette for holding a supply of receiver sheets defining a stack of sheets, comprising:

(a) a cassette body having a notch therein;

(b) a backstop movable with respect to said cassette body, said backstop connected to said cassette body for constraining movement of the stack of sheets as the individual sheets feed from the stack of sheets, said backstop including:

(i) a first prong member having a portion thereof releasably engaging the notch, so that said backstop is immovable with respect to said cassette body in a direction away from the stack of sheets as the first prong member portion engages the notch;

(ii) a second prong member disposed adjacent said first prong member; and (iii) a rotatable flexible beam interconnecting said first prong member and said second prong member to rotate said first prong member out of engagement with the notch, so that said prong member rotates and rises as said beam member is flexed, so that said first prong member portion disengages the notch as said beam rotates, and so that said backstop is movable with respect to said cassette body in a direction away from the stack of sheets as said first prong member portion disengages the notch.

8. The printer of claim 7, wherein said first prong member, said second prong member and said beam are of a single unitary construction of molded plastic.

9. A method of assembling a printer, comprising the steps of:

(a) disposing a receiver sheet supply cassette near a print head for holding a supply of receiver sheets, the supply cassette including a cassette body having a notch therein; and (b) connecting a movable backstop to the cassette body for constraining movement of the receiver sheets, including the steps of:

(i) forming a prong member having a portion thereof adapted to releasably engage the notch, so that the backstop is immovable in a direction away from the supply of sheets as the prong portion engages the notch; and (ii) connecting a beam to the prong portion to rotate and lift the prong portion out of engagement with the notch, so that the backstop is movable in a direction away from the supply of sheets as the prong portion disengages the notch; and wherein the steps of forming a prong member and connecting a beam comprises the step of forming a prong member that is molded integral with the beam so that the prong member and beam are of a single unitary construction.

10. A method of assembling a printer capable of printing an image on any of a plurality of receiver sheets defining a stack of sheets, comprising;

(a) disposing a feeder mechanism relative to a print head, the feeder mechanism capable of engaging the stack of sheets and feeding individual sheets to the print head;

(b) disposing a receiver sheet supply cassette to near the print head for holding the stack of sheets as the feeder mechanism feeds individual sheets to the print head, the cassette including a cassette body having a notch therein;

(c) providing a backstop movable with respect to the cassette body, the backstop connected to the cassette body for constraining movement of the stack of sheets as the individual sheets feed from the stack of sheets, including the steps of:

(i) providing a first prong member having a portion thereof releasably engaging the notch, so that the backstop is immovable with respect to the cassette body in a direction away from the stack of sheets as the first prong member portion engages the notch;

(ii) disposing a second prong member adjacent the first prong member; and (iii) interconnecting the first prong member and the second prong member by a rotatable flexible beam for rotating said first prong member out of engagement with the notch, so that said prong member rotates and rises as said beam member is flexed, so that said first prong member portion disengages the notch as said beam rotates, and so that said backstop is movable with respect to said cassette body in a direction away from the stack of sheets as the first prong member portion disengages the notch.

11. The method of claim 10, wherein the step of providing a first prong member, disposing a second prong member and interconnecting the first prong member and second prong member comprises the step of forming a first prong member, second prong member and beam having a single unitary construction of molded plastic.

12. A method of assembling a receiver sheet supply cassette, comprising the steps of:

(a) forming a cassette body for holding a supply of receiver sheets, the cassette body having a notch therein;

(b) integrally connecting a backstop to the cassette body for constraining movement of the receiver sheets, including the steps of:

(i) forming a prong member having a portion thereof adapted to releasably engage the notch, so that the backstop is immovable in a direction away from the stack of sheets as the prong portion engages the notch; and (ii) integrally connecting a beam to the prong portion to rotate and lift the prong portion out of engagement with the notch, so that the backstop is movable in a direction away from the stack of sheets as the prong portion disengages the notch; and wherein the steps of forming a prong member and integrally connecting a beam comprises the step of forming a prong member and integrally connecting the beam so that the prong member and the beam are of a single unitary construction.

13. The method of claim 12, wherein the steps of forming a prong member and integrally connecting a beam comprises the step of molding the prong member and the beam integrally of the same plastic.

14. A method of assembling a receiver sheet supply cassette for holding a supply of receiver sheets defining a stack of sheets, comprising the steps of:

(a) providing a cassette body having a notch therein;

(b) providing a backstop movable with respect to the cassette body, the backstop connected to the cassette body for constraining movement of the stack of sheets as the individual sheets feed from the stack of sheets, including the steps of:

(i) providing a first prong member having a portion thereof releasably engaging the notch, so that the backstop is immovable with respect to the cassette body in a direction away from the stack of sheets as the first prong member portion engages the notch;

(ii) disposing a flexible second prong member adjacent the first prong member; and (iii) interconnecting the first prong member and the second prong member by a rotatable flexible beam for rotating the first prong member out of engagement with the notch, so that the first prong member rotates and rises as the beam is flexed, so that the first prong member portion disengages the notch as the beam rotates, and so that the backstop is movable with respect to the cassette body in a direction away from the stack of sheets as the first prong member portion disengages the notch.

15. The method of claim 14, wherein the step of providing a first prong member, disposing a second prong member and interconnecting the first prong member and second prong member comprises the step of forming a first prong member, second prong member and beam having a single unitary construction of molded plastic.

16. A method of adjusting a sheet supply cassette for holding a supply of sheets defining a stack of sheets, comprising:

(a) providing a cassette body having a plurality of adjustment notches therein defining respective different positions for location of a backstop;

(b) providing a backstop movable with respect to the cassette body, the backstop being connected to the cassette body for constraining movement of the stack of sheets as the individual sheets feed from the stack of sheets, the backstop being movable in accordance with the steps of:

(i) providing a first prong member having a stop portion thereof releasably engaging one of the notches, so that the backstop is immovable with respect to the cassette body in a direction away from the stack of sheets as the first prong member portion engages one of the notches;

(ii) providing a flexible second prong member adjacent the first prong member so that the first prong member and the second prong member may be grasped between two fingers; and (iii) pinching together the first and second prong members so that a beam that is molded integral with the first prong member is caused to rotate and thereby lift the stop portion out of the notch to allow the backstop to be moved away from the stack of sheets.

* * * * *